US007559579B2

(12) United States Patent
Furlani

(10) Patent No.: US 7,559,579 B2
(45) Date of Patent: Jul. 14, 2009

(54) SUPPORT MECHANISM FOR SNOWBOARDS

(76) Inventor: Christopher B. Furlani, 212 Blackberry Cir., Colchester, VT (US) 05446

( * ) Notice: Subject to any disclaimer, the term of this patent is extended or adjusted under 35 U.S.C. 154(b) by 0 days.

(21) Appl. No.: 11/745,202

(22) Filed: May 7, 2007

(65) Prior Publication Data

US 2008/0111015 A1 May 15, 2008

Related U.S. Application Data

(63) Continuation of application No. 10/402,417, filed on Mar. 28, 2003, now Pat. No. 7,222,883.

(60) Provisional application No. 60/368,293, filed on Mar. 28, 2002.

(51) Int. Cl.
*A63C 11/00* (2006.01)

(52) U.S. Cl. ..... 280/809; 280/814; 280/14.21

(58) Field of Classification Search ..... 280/814, 280/816, 637, 87.041, 87.042; 224/267, 224/222, 254, 255, 218, 250, 517
See application file for complete search history.

(56) References Cited

U.S. PATENT DOCUMENTS 3,825,274 A * 7/1974 Weinstein ..... 280/623
4,685,697 A * 8/1987 Thorley ..... 280/637
4,887,825 A * 12/1989 Allen et al. ..... 280/87.042
5,026,088 A * 6/1991 Stuart ..... 280/637
5,194,026 A * 3/1993 Corwin et al. ..... 441/75
5,490,805 A * 2/1996 Bredesen ..... 441/75
5,857,682 A * 1/1999 Hyman ..... 280/14.21
5,887,550 A * 3/1999 Levine et al. ..... 119/796
5,902,164 A * 5/1999 Shoemaker ..... 441/75
5,904,056 A * 5/1999 Ozaki ..... 70/18
6,062,111 A * 5/2000 Wershe ..... 81/177.4
6,192,719 B1 * 2/2001 Stukas et al. ..... 70/18
6,286,397 B1 * 9/2001 Taggart et al. ..... 81/63.1
6,349,968 B1 * 2/2002 Crego et al. ..... 280/809
6,457,746 B1 * 10/2002 Schepers ..... 280/809
6,500,039 B1 * 12/2002 Underwood ..... 441/75
6,702,328 B2 * 3/2004 Malleis et al. ..... 280/809
2003/0089141 A1 * 5/2003 Edwards et al. ..... 70/18

* cited by examiner

*Primary Examiner*—Christopher P Ellis
*Assistant Examiner*—John D. Walters
(74) *Attorney, Agent, or Firm*—Saeyfarth Shaw LLP; John C. Serio

(57) ABSTRACT

A mechanism for snowboard support while riding a chair lift is provided. The support mechanism includes a flexible retractable cable within a housing having a recoil mechanism. The housing is advantageously mounted to the snowboard or the snowboard binding mechanism. The recoil assembly has two main elements, a housing member which stores a retractable cable and a spring assembly that retracts the flexible cable advantageously into the housing member. The recoil assembly allows for adjustment of an elongation length of the retractable flexible cable.

13 Claims, 5 Drawing Sheets

SUPPORT MECHANISM FOR SNOWBOARDS

RELATED APPLICATION

This application is a continuation of U.S. patent application Ser. No. 10/402,417, filed on Mar. 28, 2003, now U.S. Pat. No. 7,222,883 which claims priory to U.S. provisional application 60/368,293 filed on Mar. 28, 2002, both of which are incorporated by reference in their entirety.

FIELD OF INVENTION

This invention relates to the sport of snowboarding and to an arrangement for supporting the weight of a snowboard while riding up a chairlift.

BACKGROUND OF INVENTION

Snowboarding is a rather new sport that began in the United States in the 1960s. Back then a short-thin board with a rope attached at the nose, called the "Snurfer", was ridden without bindings. In the 1970s the current snowboard shape began to evolve, but it wasn't until the early 1980's that steel edges and P-tex bases popular with skis were introduced into snowboard technology.

This steel edge technology gave the control necessary in all snow conditions and the growth of the sport has mushroomed ever since. As is generally understood snowboarding is one of the rapidly growing sports today, with its enjoyment currently in excess of skiers for young people entering winter sports. In the early days of snowboarding many ski areas did not permit snowboarding on their slopes. Today, due in part to the improved image of snowboarding brought about by organized competition and the growing popularity of the sport itself only a few areas discriminate against snowboarders. The popularity and acceptance of snowboarding has spread worldwide. Snowboarding was recently recognized by the International Olympic Committee as a full medal sport for the 1998 Olympic Games in Japan.

While the popularity of snowboarding has seen explosive growth among young people its popularity has also been embraced by older people as an alternative to skiing. As the sport has evolved a series of improvements in equipment has occurred. It has been found desirable to fasten the snowboarder rider into place with a variety of specialized bindings. These bindings have taken the shape of several forms, however, common among all is the need to have the forward foot of a rider secured at all times.

Snowboard riders traditionally remove one of their boots from its binding for the ride up the chairlift. The free boot allows the rider to maneuver through the chairlift lines and onto the chairlift itself. The snowboard rider can either support the snowboard with the free foot or just let the snowboard hang by the foot secured in the front mounting. In the case where the snowboard is supported by the free foot this method of support often results in stress fatigue and discomfort to the leg supporting the board. In the case where the snowboard is hanging freely, the weight of the board has the tendency to cause injury to the ligaments, tendons and muscles of the foot bound in the binding. The weight of the snowboard itself has a tendency to pull on the ligaments, tendons, muscles, etc., causing damage over time that is exacerbated with the natural fatigue to the rider's leg that has tired through hours of activity.

Even with newer snowboards that have taken advantage of progress in material science to produce lighter weight snowboards made of fiberglass or similar resins, this undesirable stress upon the fixed foot's tendons, ligaments and muscles has not been alleviated. Unfortunately, during the course of a day, this stress, fatigue and discomfort reduces enjoyment of the sport and most importantly increases the chance of serious injury to the snowboard rider.

Prior solutions have produced a variety of leashing and strapping arrangements that consist of various methods to alleviate this fatigue to the snowboarder. U.S. Pat. No. 6,349,968 to Crego et al. ("Crego") is a temporary hold-up device for a snowboard support. Crego discloses a temporary hold-up device for snowboard support that uses a substantially stiff cord to temporary support the board during the chairlift ride. The rider engages the unfastened binding mechanism with this substantially stiff cord to help support the weight of the snowboard during the chairlift ride. Unfortunately, this device is cumbersome and storage of the device between its use is problematic.

Another attempt to solve the problem of leg strain due to unsupported snowboard weight can be found in U.S. Pat. No. 6,290,260 to Brill ("Brill"). Brill provides a detachable loop strap which encircles a portion of the snowboard and goes over the rider's knee. The detachable loop of Brill appears to be a cumbersome and difficult device to use. Unfortunately, Brill much like Crego suffers from difficulty in use and storage of the device between use.

Accordingly, there is need for a device that will serve to support the snowboard in a way to prevent fatigue when the snowboarder is riding a chair lift or the like. There is further need for a support device that is compact and contains a convenient method for storage between its use.

SUMMARY OF INVENTION

Accordingly, it is an object of the present invention to provide a support mechanism for snowboard support while riding a chair lift. This support mechanism includes a retractable flexible cable contained within a housing having a recoil mechanism. The housing containing the retractable flexible cable is advantageously mounted to the snowboard or the binding mechanism of the snowboard assembly. The housing member having the retractable flexible cable has a coil spring assembly that retracts the flexible cable advantageously into the housing member. The housing member is strategically mounded to the snowboard or to the binding mechanism.

As the snowboard rider desires additional support for the weight of the snowboard, the free end of the retractable flexible cable is pulled to remove the cable from the housing member. The free end of the retractable cable is fitted with a handle having a configuration allowing the snowboard rider the ability to grasp the cable in their hand or to latch the retractable cable onto the chairlift's safety bar.

In an alternative illustrative embodiment, the handle may also be fitted with a locking member allowing the snowboard owner to secure their untended snowboard thereby preventing theft. The locking member within the handle configuration may be released by use of a combination lock or key. The housing member may further contain a retraction button on the housing member that causes the retractable flexible cable to rewind within the housing or it can be used to adjust the elongation length of the flexible cable.

The retractable flexible cable according to the invention can be adjusted to a desirable length for the comfort of various sizes of snowboard riders. Similarly, for securing the snowboard during periods of rest, the free end of the cable may be inserted around a stationary object, prior to insertion of the locking member into the receptor member contained within the housing member.

In yet a further alternative illustrative embodiment the handle on the free end of the retractable flexible cable can be further configured to accommodate tools, such as screwdriver heads, nut drivers or the like enabling the snowboarder the ability to adjust their equipment.

According to the invention, the housing member can be attached to the snowboard through the use of fasteners or adhesives. Similarly, the housing member can be attached to the binding mechanism through the use of fasteners.

In a further alternative illustrative embodiment the retractable flexible cable can be a pre-selected length so that adjustments to the cable length by the use of a retractable button are not necessary.

BRIEF DESCRIPTION OF THE DRAWINGS

The foregoing and other features and advantages of the present invention will be more fully understood from the following detailed description of illustrative embodiments, taken in conjunction with the accompanying drawing in which.

DETAILED DESCRIPTION OF THE INVENTION

Detailed embodiments of the present invention are disclosed herein, however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
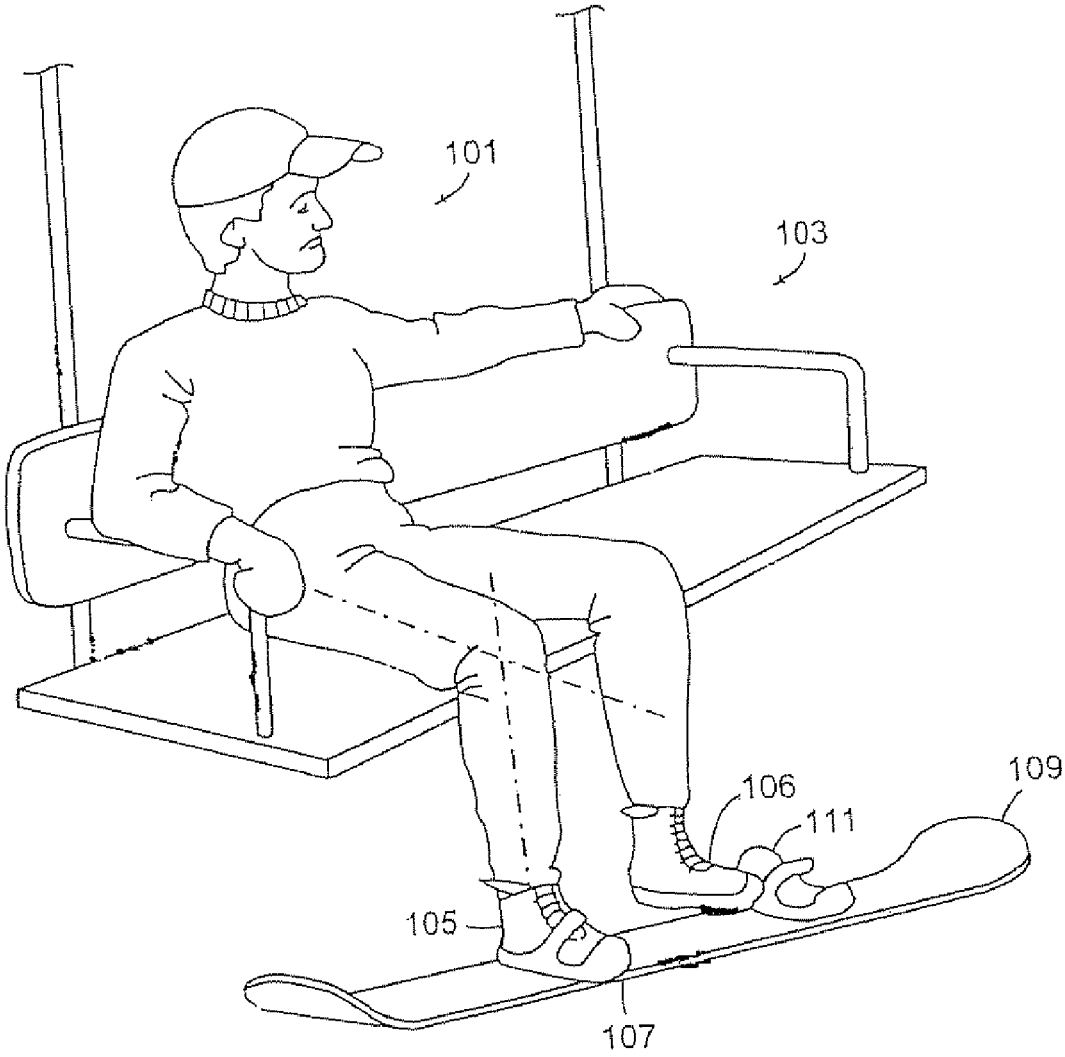
FIG. 1 (PRIOR ART)
FIG. 1 illustrates a traditional method of riding a chairlift with a snowboard having a back leg released from a binding mechanism.

As shown in FIG. 1, typically a snowboarder 101 rides a chairlift 103 having a forward leg 105 securely strapped into a forward binding mechanism 107. The forward binding mechanism 107 is secured to a snowboard 109 as is a back binding mechanism 111. The back foot 106 of the snowboarder 101 is released from the back binding mechanism 111 prior to chairlift loading in order to allow the snowboarder 101 the ability to traverse and maneuver onto the chairlift 103. As the snowboarder 101 rides the chairlift 103 the weight of the snowboard is supported solely by the forward leg 105. This support over time causes the forward leg 105 to become fatigued.

Figure 2:
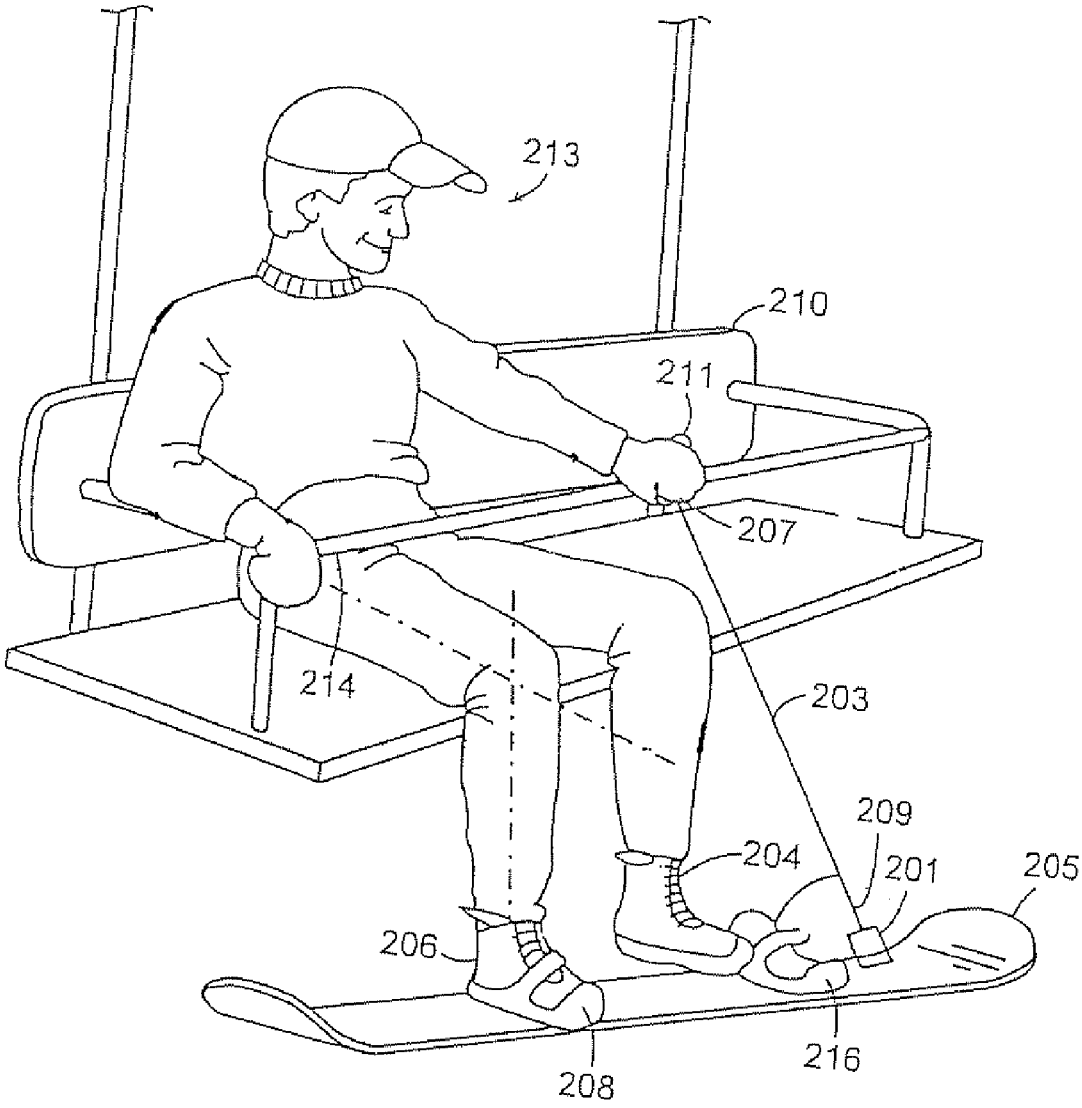
FIG. 2 illustrates the method according to the invention of riding a chairlift with a snowboard while using the inventive support mechanism.

According to the invention, as shown in FIG. 2, a housing 201 having a retractable flexible cable 203 is mounted upon a snowboard 205. The retractable flexible cable 203 has a free end 207 and a retracted end 209. The free end 207 is equipped with a handle 211. It is contemplated within the scope of the invention that the handle 211 may be configured to allow a snowboarder 213 the option of attaching the handle 211 to a safety bar 214 on a chairlift 210. The handle 211 is held by a snowboarder 213 to assist in the support of the snowboard 205. The snowboarder 213 having their forward leg 206 fastened into a front binding mechanism 208 and their back leg 204 unfastened from a back binding mechanism 216 is able to support the weight of the snowboard 205 by grasping the handle 211.

The housing 201 contains a coil spring driven recoil mechanism that recoils the retractable flexible cable 203 when the snowboarder 213 releases the handle 211. It is contemplated within the scope of the invention that the housing 201 may be attached to the snowboard 205 using fasteners or adhesives known in the art.

The housing is advantageously attached within the vicinity of the back binding mechanism 216. It is further contemplated within the scope of the invention that the housing 201 may be attached to the back binding mechanism 216. The attachment of the housing 201 can be of a permanent nature or it can be removably attached to either the snowboard 205 or the back binding mechanism 216.

In operation of the inventive apparatus, when the snowboarder 213 sits on the chairlift 210, he or she simply grasps the handle 211 of the retractable flexible cable 203 and adjusts the length to their comfort by the use of a release button contained within the housing 201 or by having a retractable flexible cable 203 having a pre-selected elongation length that is sized to the snowboarder's comfort.

Figure 3:
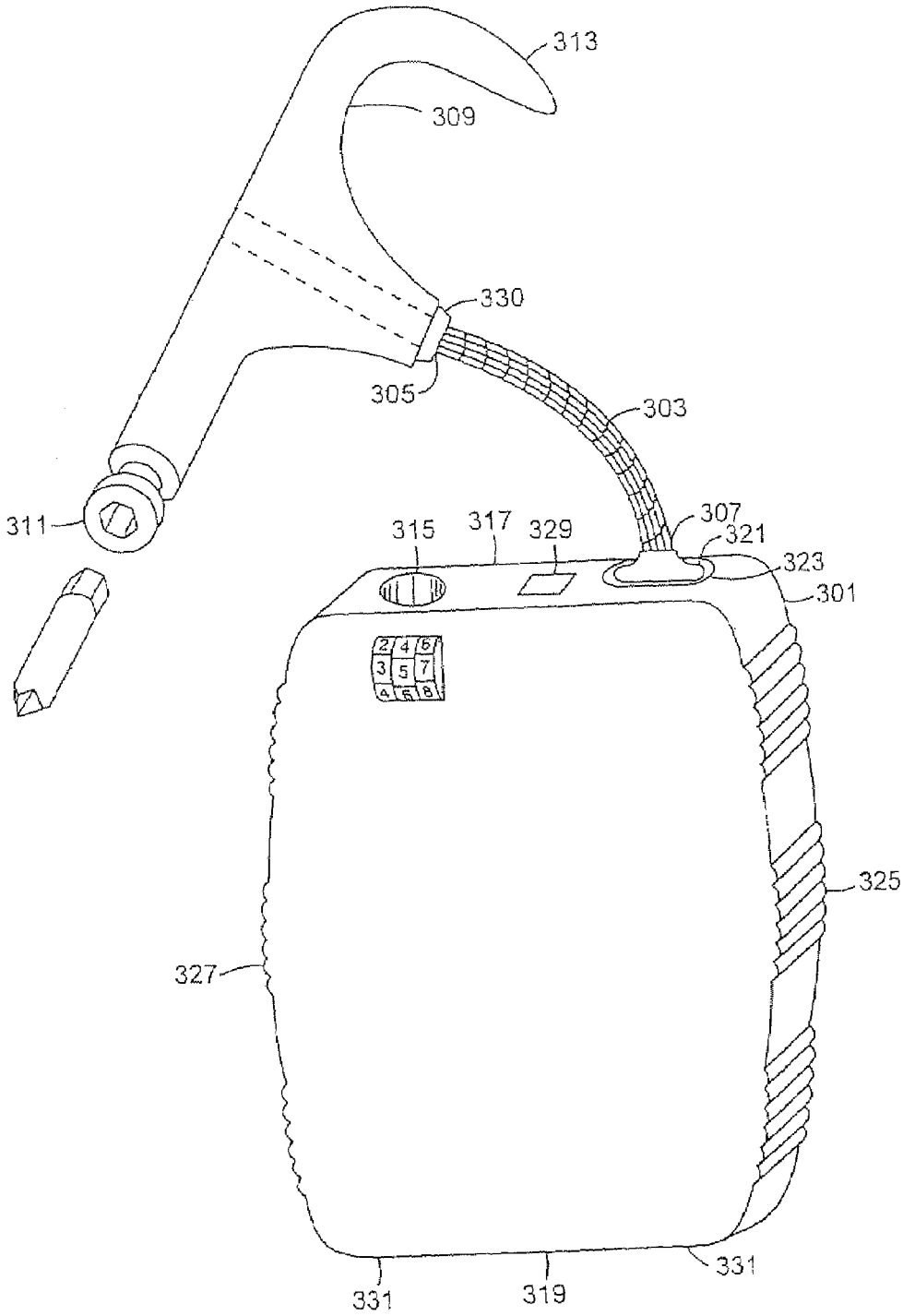
FIG. 3 illustrates the apparatus according to the invention having a housing with a retractable flexible cable.

Turning to FIG. 3 a housing 301 having a retractable flexible cable 303 according to the invention is shown. The housing 301 in a first illustrative embodiment is constructed of injected molded plastic. It is contemplated within the scope of the invention that the housing 303 may also be constructed of materials known in the art, such as metal alloys or the like. The flexible retractable cable 303 in a first illustrative embodiment is fabricated from a flexible steel cable that has been covered with a drag resistant plastic coating. It is contemplated within the scope of the invention that other materials known in the art may be used, such as nylon rope, fibrous woven rope, mountaineering rope or the like.

The retractable flexible cable 303 has a free end 305 and a retractable end 307. The free end 305 of the retractable flexible cable 303 is fitted with a tee shaped handle 309. The tee shaped handle 309 in a first illustrative embodiment is fabricated from soft rubber and is configured to allow a snowboarder to firmly grasp the tee shaped handle 309. It is contemplated within the scope of the invention that the tee shaped handle 309 may be fabricated from a variety of plastics and metal alloys. It is further contemplated that the tee shaped handle 309 may be of other geometric forms such as u-shaped or the like.

As shown in FIG. 3 the tee shaped handle 309 has a first end 311 and a second end 313. The first end 311 is configured to allow it to act as male portion of a locking mechanism. The housing 301 is further equipped with a housing locking mechanism 315. The housing locking mechanism 315 is configured to allow the first end 311 of the handle 309 to be securely inserted into the housing locking mechanism 315. The securely inserted first end 311 of the handle 309 allows the snowboarder to secure and lock his or her snowboard while not in use to prevent theft. The housing locking mechanism 315 may be equipped with either a combination or a key lock to securing the first end 311 into the housing member 301.

In an alternative illustrative embodiment the second end 313 of the handle 309 is configured in the form of a hook allowing the snowboarder the ability to hook the handle 311 to a safety bar on the chairlift. The hook can be a quick release snap-type hook as used in mountaineering or can be merely a right angle hook for attachment to the safety bar.

In a further illustrative embodiment one or both ends 311, 313 of the handle 309 of the retractable flexible cable 303 can be further configured to accommodate tools, such as screwdrivers head, nut drivers, or the like enabling snowboard riders the ability to adjust their equipment.

In yet a further illustrative embodiment the handle 311 is equipped with a plastic mesh strap having a break-a-way Velcro® fastening system allowing the snowboarder the ability to secure the retractable flexible cable 303 to a portion of the chairlift assembly.

As depicted in FIG. 3 the housing 301 has a top end 317 and a bottom end 319. The top end 319 has an opening 321 allowing for the retractable flexible cable 303 to be released or retracted in and out of the housing 301. The opening is fitted with a tapered grommet 323 that allows the retractable flexible cable 303 drag resistant movement in and out of the housing 301. The tapered grommet 323 may be fabricated from nylon or other plastics that allow for a reduced drag coefficient upon the retractable flexible cable 303. The tapered grommet 323 receives a tapered portion 330 of the handle 311 allowing the handle 311 in the retracted position to seal the housing 311 from moisture.

The bottom end 319 of the housing is configured to allow the housing 311 to be securely or removeably fastened to the snowboard. The housing 301 also has a proximal side 325 and a distal side 327. Either the proximal side 325 or the distal side 327 can be configured to receive fasteners allowing the housing 301 to be securely or removable fastened to a binding mechanism. The bottom end 319 of the housing 311 is further equipped with drain holes 331 allowing moisture to drain from the housing 301.

The top end 317 of the housing 301 is further equipped with a release mechanism 329. The release mechanism 329 is engaged with the recoil mechanism allowing adjustment to the elongation length of the retractable flexible cable 303. It is contemplated within the scope of the invention that the elongation length of the retractable flexible cable 303 can be adjusted by the use of the release mechanism 329. It is further contemplated that the retractable flexible cable 303 can have a pre-selected length.

Figure 4:
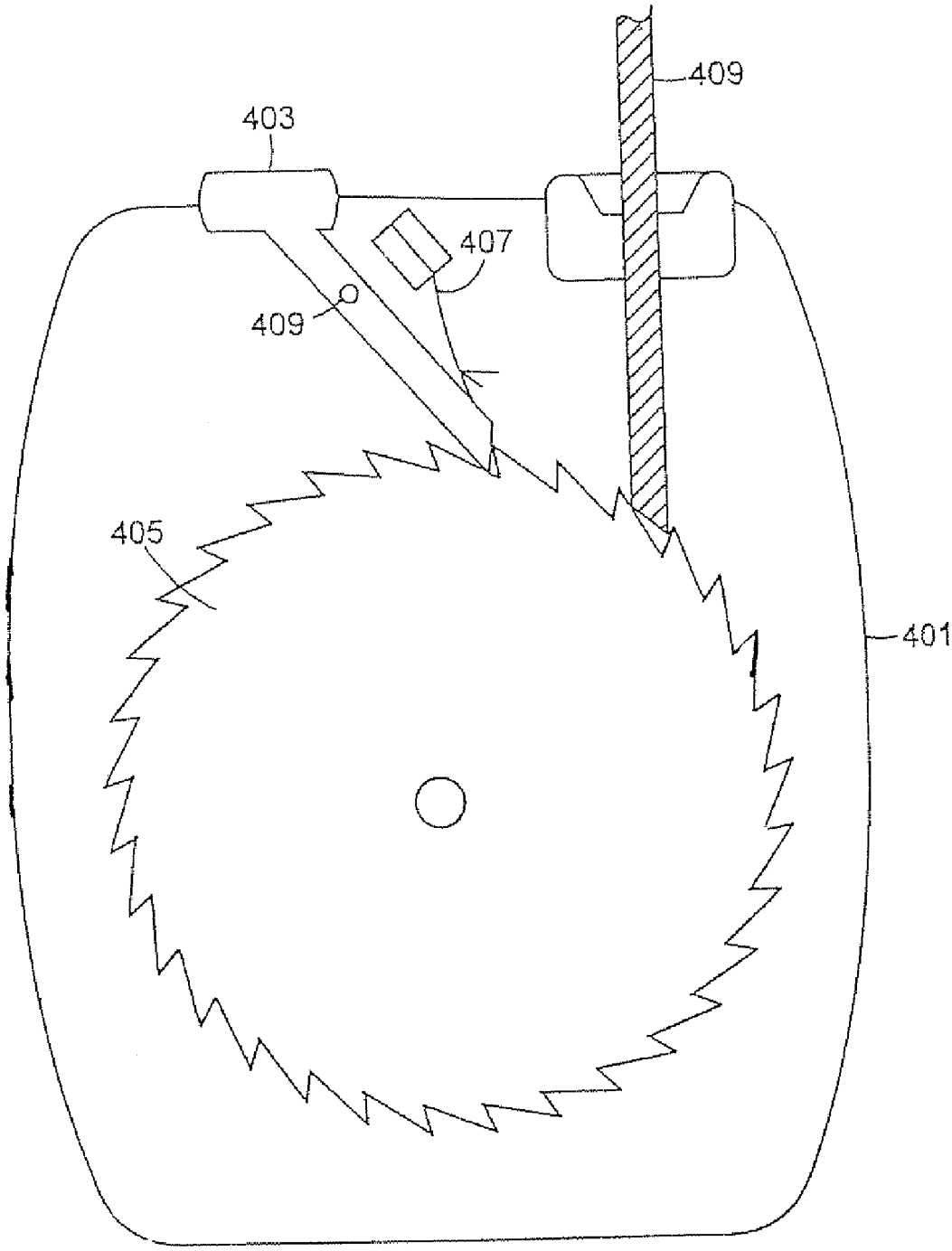
FIG. 4 is a top cross sectional view of the housing containing the retractable flexible cable according to the invention.

Turing to FIG. 4 a top cross sectional view of a housing 401 according to the invention is shown. The housing 401 contains a release mechanism 403 allowing for adjustment to the elongation length of a retractable flexible cable 409. The release mechanism 403 engages or disengages a ratchet assembly 405 by the use of a spring 407 engaged ratchet stop 409. The ratchet assembly 405 is attached to a coil spring recoil mechanism (not shown) that recoils the retractable flexible cable 409. It is contemplated within the scope of the invention that other means for adjustment of the retractable flexible cable 409 known in the art may be used, such as friction engagement or the like.

Figure 5:
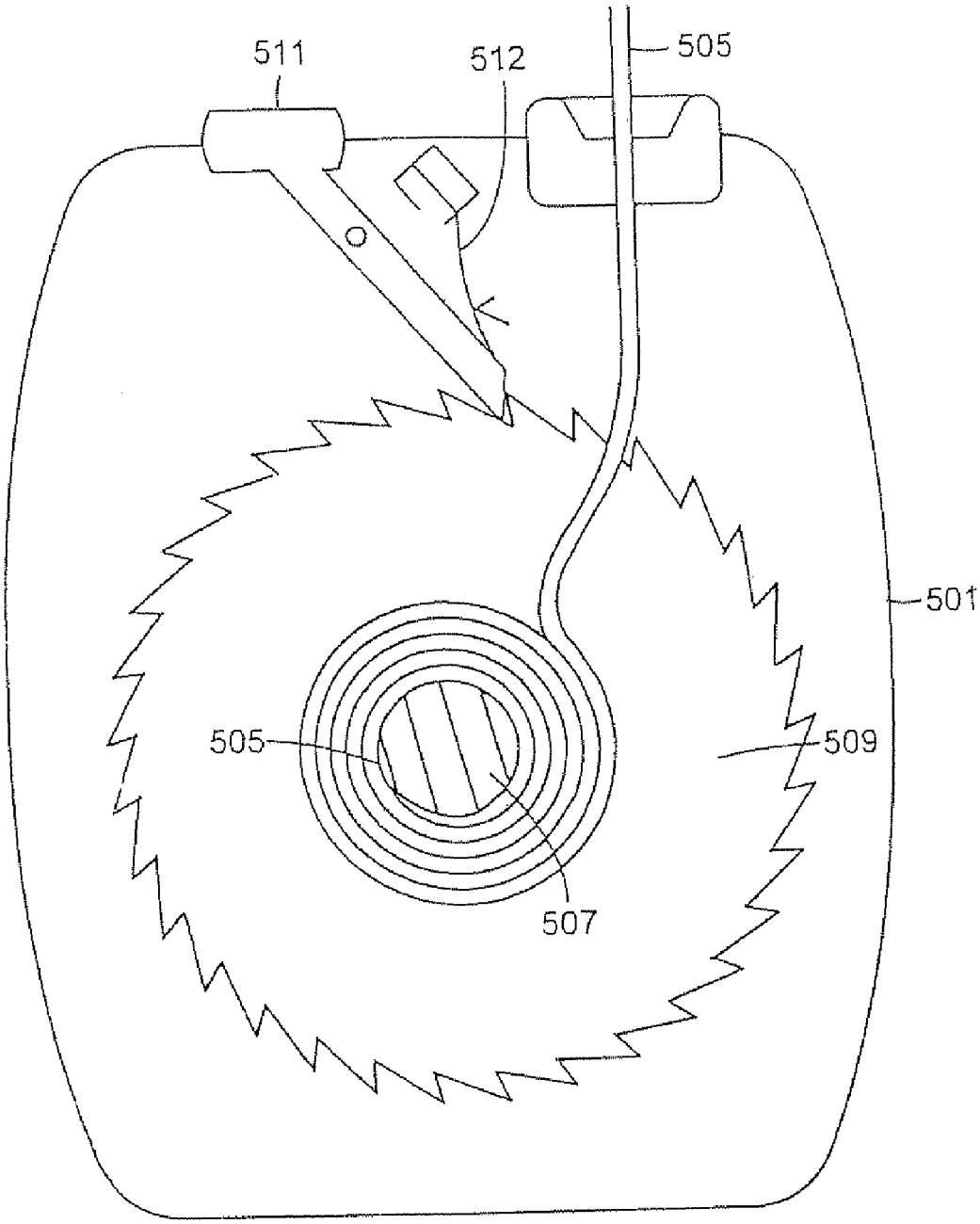
FIG. 5 is a bottom cross sectional view of the housing containing the retractable flexible cable according to the invention.

Turning to FIG. 5 a bottom cross sectional view of the housing 501 according to the invention is shown. The retractable end 503 of a retractable flexible cable 505 is attached to a coil spring 507. The coil spring 507 is fastened to a ratchet assembly 509. The coil spring 507 is configured from spring steel as known in the art. The ratchet assembly 509 is engaged by a spring 512 assisted release mechanism 511 allowing for adjustment to the elongation length of the retractable flexible cable 505 as described above.

Although the illustrative embodiment uses a ratchet assembly to adjust the elongation length of the retractable flexible cable, it should be appreciated by those skilled in the art that methods such as fiction engagement or the like may be used as a means for adjustment.

Although the illustrative embodiment is attached to the snowboard or binding mechanism, it should be appreciated by those skilled in the art that the retractable flexible cable apparatus can be incorporated into the structure of snowboard binding mechanisms.

Although the illustrative embodiment is used for a support mechanism or locking mechanism, it should be appreciated by those skilled in the art that the retractable flexible cable can be used as a safety leash for the snowboard.

The foregoing has been a description of certain specific embodiments of the present disclosure. The present disclosure is not to be limited in scope by the illustrative embodiments described which are intended as specific illustrations of individual aspects of the disclosure, and functionally equivalent methods and components are within the scope of the invention. Indeed, various modifications of the disclosure, in addition to those shown and described herein will become apparent to those skilled in the art from the foregoing description and all such modifications are included.

What is claimed is:

1. An apparatus for supporting the weight of a snowboard comprising:

a housing member having a recoil mechanism;

a flexible cable contained within said housing member, said flexible cable having a free end and a retractable end;

a handle attached to said free end of said flexible cable said retractable end being attached to said recoil mechanism, wherein said handle is configured to have an interchangeable bits and nut driver tool;

a means for attaching said housing member to said snowboard.

2. The apparatus of claim 1 wherein said handle is configured to have a locking member that locks into said housing member.

3. The apparatus of claim 2 wherein said locking member is locked by a combination lock.

4. The apparatus of claim 1 wherein said recoil mechanism has a means for adjusting length of said flexible cable within the housing of said recoil mechanism.

5. The apparatus of claim 1 wherein said flexible cable is selected from the group consisting of steel cable and nylon cable.

6. The apparatus of claim 1 wherein said flexible cable is a steel cable having a drag resistant plastic coating.

7. The apparatus of claim 1 wherein said recoil mechanism further comprises a ratchet assembly having a means for adjusting elongation length of said flexible cable.

8. The apparatus of claim 1 wherein said flexible cable has a pre-selected elongation length.

9. The apparatus of claim 1 wherein said flexible cable has an adjustable elongation length.

10. A method for supporting the weight of a snowboard to prevent injury to a snowboard rider, said method comprising the steps of:

providing a retractable flexible cable within a housing, said retractable flexible cable having a free end having a handle, wherein said handle is configured to have an interchangeable bits and nut driver tool;

mounting said housing on said snowboard wherein said retractable flexible cable has a pre-selected elongation length allowing a snowboard rider to support weight of said snowboard by elongating said retractable flexible cable.

11. The method according to claim 10 wherein said retractable flexible cable is selected from the group consisting of nylon cable and steel cable.

12. The method according to claim 10 further comprising providing a handle configured to have a locking member that locks into said housing.

13. An apparatus for supporting the weight of a snowboard comprising:

a housing member having a means for recoil;

a flexible cable having a selected length contained within said housing member, said flexible cable attached to said means for recoil;

a handle attached to said flexible cable said handle having a means for locking, wherein said handle is configured to have an interchangeable bits and nut driver tool;

said means for recoil having a means of adjustment to said selected length of said flexible cable within the housing of said recoil mechanism; and a means for attaching said housing member to said snowboard.

* * * * *

UNITED STATES PATENT AND TRADEMARK OFFICE

CERTIFICATE OF CORRECTION

PATENT NO. : 7,559,579 B2
APPLICATION NO. : 11/745202
DATED : July 14, 2009
INVENTOR(S) : Christopher B. Furlani It is certified that error appears in the above-identified patent and that said Letters Patent is hereby corrected as shown below:

Title Page; item (74);

(74) Attorney, Agent, or Firm - Saeyfarth Shaw LLP; John C. Serio should be corrected to read:

(74) Attorney, Agent, or Firm - Seyfarth Shaw LLP; John C. Serio

Signed and Sealed this

Twenty-second Day of September, 2009

David J. Kappos

David J. Kappos
*Director of the United States Patent and Trademark Office*